US007634102B2

(12) United States Patent
Takase et al.

(10) Patent No.: US 7,634,102 B2
(45) Date of Patent: Dec. 15, 2009

(54) SPEAKER AND DEVICE USING THE SAME

(75) Inventors: Tomoyasu Takase, Mie (JP); Mitsutaka Enomoto, Mie (JP); Kazuya Yamasaki, Osaka (JP); Kazutaka Kubo, Mie (JP); Takeshi Shimokawatoko, Mie (JP); Masahide Sumiyama, Mie (JP)

(73) Assignee: Panasonic Corporation, Osaka (JP)

( * ) Notice: Subject to any disclaimer, the term of this patent is extended or adjusted under 35 U.S.C. 154(b) by 823 days.

(21) Appl. No.: 10/533,632

(22) PCT Filed: Nov. 22, 2004

(86) PCT No.: PCT/JP2004/017663

§ 371 (c)(1),
(2), (4) Date: May 2, 2005

(87) PCT Pub. No.: WO2005/062664

PCT Pub. Date: Jul. 7, 2005

(65) Prior Publication Data

US 2006/0153420 A1 Jul. 13, 2006

(30) Foreign Application Priority Data

Dec. 22, 2003 (JP) ..... 2003-424128
Sep. 2, 2004 (JP) ..... 2004-255209

(51) Int. Cl.
*H04R 25/00* (2006.01)

(52) U.S. Cl. ..... 381/423; 381/430; 381/396

(58) Field of Classification Search ..... 381/152, 381/184, 398, 403, 423, 424, 430, 431; 181/163, 181/164, 165, 171; 379/431, 433.02, 432
See application file for complete search history.

(56) References Cited

U.S. PATENT DOCUMENTS 6,154,556 A 11/2000 Takahashi et al.

(Continued)

FOREIGN PATENT DOCUMENTS

JP 50-89330 7/1975

(Continued)

OTHER PUBLICATIONS

Chinese Office Action issued Jul. 24, 2009 in a counterpart Chinese application.

*Primary Examiner*—Huyen D Le
(74) *Attorney, Agent, or Firm*—Wenderoth, LInd & Ponack, L.L.P.

(57) ABSTRACT

A loudspeaker includes a magnetic circuit having a magnetic gap, a frame coupled to the magnetic circuit, a voice coil having a first end positioned in the magnetic gap and a second end opposite to the first end, and a diaphragm coupled to the second end of the voice coil and the frame. The voice coil has a center axis provided through the first end and the second end. The diaphragm has a first portion in which the center axis of the voice coil is provided. The first portion of the diaphragm is provided inside the voice coil. The diaphragm further has a second portion outside the voice coil. One of the first portion and the second portion of the diaphragm has a cross section in a plane including the center axis, and the cross section of the one of the first portion and the second portion of the diaphragm has an elliptic-arc shape. This loudspeaker has a small thickness, has a high sound pressure level in a high frequency range, and secures a wide reproduction range in high frequencies.

7 Claims, 10 Drawing Sheets

U.S. PATENT DOCUMENTS

| | | | | |
|---|---|---|---|---|
| 6,792,127 | B1 | 9/2004 | Anthony et al. | |
| 7,050,600 | B2 * | 5/2006 | Saiki et al. | 381/388 |
| 7,120,264 | B2 * | 10/2006 | Saiki et al. | 381/184 |
| 7,221,773 | B2 * | 5/2007 | Takahashi | 381/430 |
| 2003/0215109 | A1 | 11/2003 | Kosuda | |
| 2004/0037441 | A1 | 2/2004 | Konishi et al. | |
| 2007/0202742 | A1 * | 8/2007 | Honda et al. | 439/587 |

FOREIGN PATENT DOCUMENTS

| | | |
|---|---|---|
| JP | 52-069611 | 6/1977 |
| JP | 53-51152 | 12/1978 |
| JP | 55-149596 | 11/1980 |
| JP | 59-50191 | 4/1984 |
| JP | 60-177591 | 11/1985 |
| JP | 62-053600 | 3/1987 |
| JP | 4-058700 | 2/1992 |
| JP | 5-88091 | 11/1993 |
| JP | 6-225385 | 8/1994 |
| JP | 11-146487 | 5/1999 |
| JP | 2001-086590 | 3/2001 |
| JP | 2001-169386 | 6/2001 |
| JP | 2002-125290 | 4/2002 |
| JP | 2002-186903 | 7/2002 |
| JP | 2002-252896 | 9/2002 |
| JP | 2003-158787 | 5/2003 |
| JP | 2003-235097 | 8/2003 |
| JP | 2003-333689 | 11/2003 |

* cited by examiner

Fig. 16 – PRIOR ART
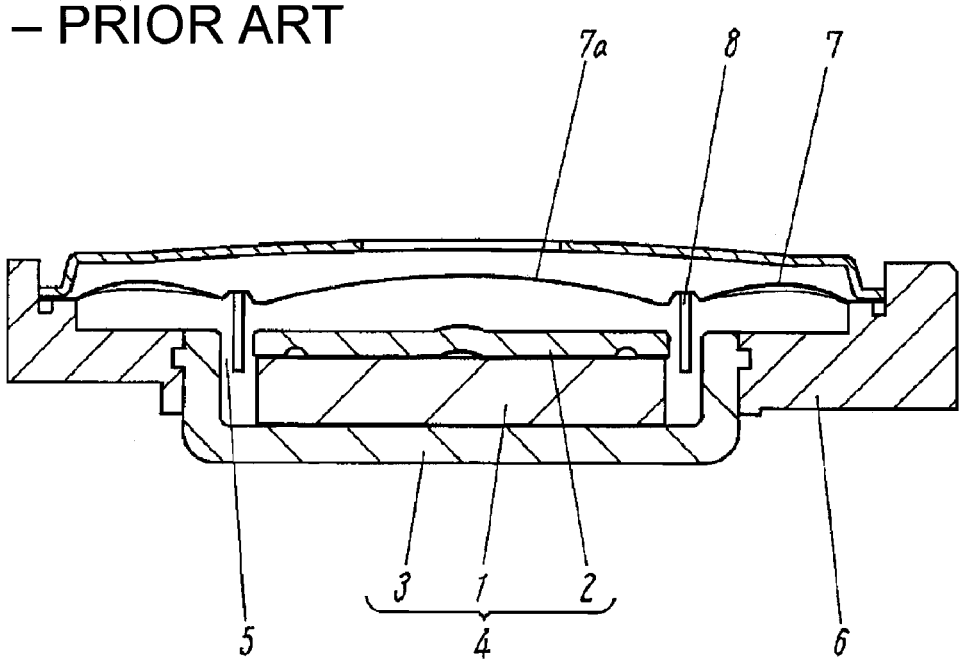
Fig. 17 – PRIOR ART
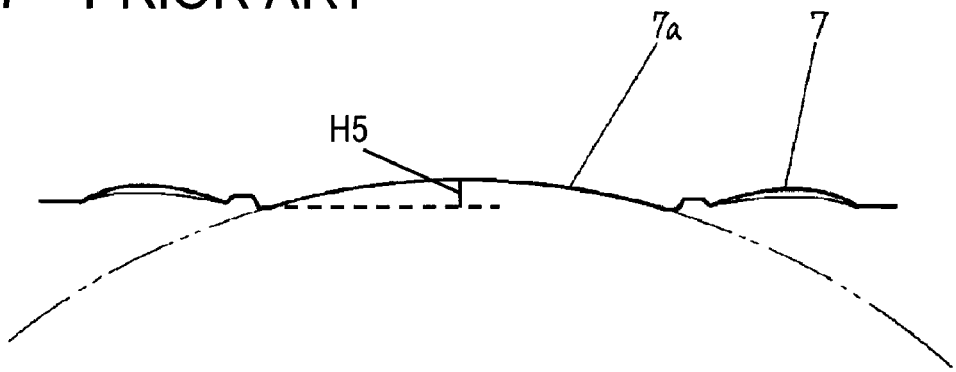
Fig. 18 – PRIOR ART
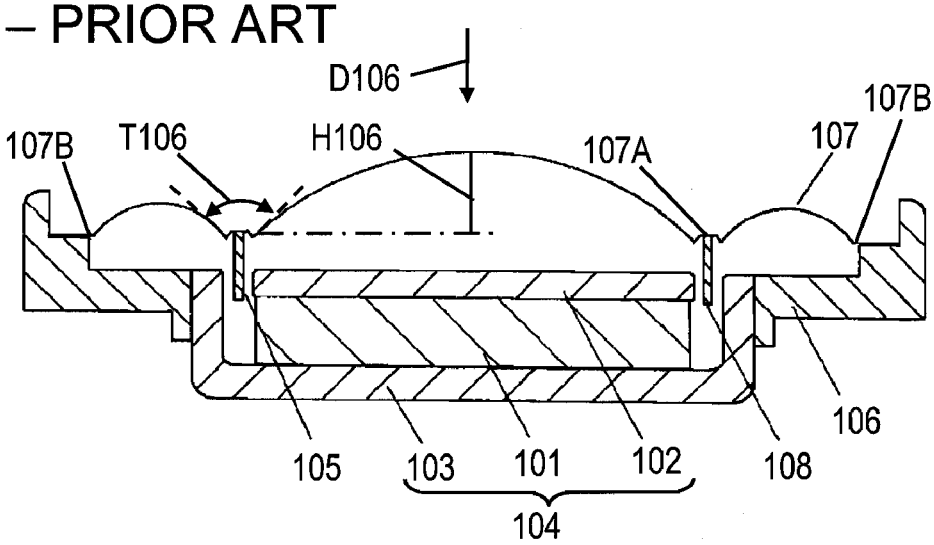

SPEAKER AND DEVICE USING THE SAME

FIELD OF THE INVENTION

The present invention relates to a loudspeaker and an apparatus using the loudspeaker, such as an acoustical device, an information communication device, a portable telephone, or a game device.

BACKGROUND OF THE INVENTION

A conventional loudspeaker disclosed in Japanese Utility Model Laid-Open Publication No. 59-50191 will be described. FIG. 16 is a cross-sectional view of the conventional loudspeaker. FIG. 17 is a cross-sectional view of a diaphragm, an essential portion of the conventional loudspeaker. Magnetic circuit 4 includes upper plate 2, yoke 3, and magnet 1 provided between upper plate 2 and yoke 3. Yoke 3 is coupled to frame 6 with an adhesive. A periphery of frame 6 is adhered to diaphragm 7. Voice coil 8 is adhered to diaphragm 7 and is positioned in magnetic gap 5 of magnetic circuit 4. As shown in FIG. 17, diaphragm 7 has convex portion 7*a* at the center portion. Convex portion 7*a* has an arc cross section.

In order to have a small thickness, this loudspeaker includes components having low profiles. If overall height H5 of diaphragm 7 is small, diaphragm 7 has a small rigidity, and may be prevented from transmitting vibration of voice coil 8. This may reduce a sound pressure level in a high frequency range and lower an upper limit frequency, narrowing a reproduced frequency range.

FIG. 18 is a cross-sectional view of another conventional loudspeaker disclosed in Japanese Patent Laid-Open Publication No. 2003-235097. Magnetic circuit 104 includes upper plate 102, yoke 103, and magnet 101 provided between upper plate 102 and yoke 103. Yoke 103 is coupled to frame 106. A periphery of frame 106 is coupled to diaphragm 107 made of a resin film. Voice coil 108 has a circular cross section substantially parallel to diaphragm 107 and has a cylinder shape. One end of voice coil 108 is coupled to diaphragm 107 while the other end of voice coil 108 is positioned in magnetic gap 105 of magnetic circuit 104. An outer shape of diaphragm 107 seen from direction D106 is an elliptical shape that can be placed at a side of a display of a portable telephone. A cross section of diaphragm 107 inside coupling section 107A at which the diaphragm is coupled voice coil 108 has a substantially dome-like shape.

The conventional loudspeaker shown in FIG. 18 has been strongly required to have a small thickness and a small size according to a demand for an electronic device including the loudspeaker, such as a portable telephone, with a small thickness and a small size. In particular, an apparatus receiving stereo sound, such as a portable telephone, includes two loudspeakers provided at both sides of a display, such as a liquid crystal display, thus requiring an area for the loudspeakers that is twice as large as an area for a loudspeaker of a monaural sound apparatus. Furthermore, such stereo sound apparatus includes an electronic circuit for signal-processing and sound-amplifying that requires a larger area than the monaural sound apparatus.

Various types of small, slim loudspeakers have been developed in which their diaphragms do not have circular shapes but have shapes having longitudinal directions, such as ellipse shapes, track-like oval shapes, and rectangular shapes. The slim loudspeakers are positioned at both sides of a display, such as a liquid crystal display, so that its longitudinal direction is parallel to the display. Thus, the shape of the loudspeaker in its plane direction reduces the size of an apparatus for reproducing stereo sound.

The apparatus described above also requires that the loudspeaker has a small thickness. The diaphragm, having a reduced height H106, has a small rigidity, hence causing unnecessary resonance and affecting its sound pressure frequency characteristics.

The slim loudspeakers often include diaphragms having outer shapes other than a circular shape, and a circular voice coil. Thus, a portion of diaphragm 107 from voice coil 108 to outer periphery 107B hardly resonates. Upon being driven by circular voice coil 108, diaphragm 107 having an outer shape other than a circular shape has dispersed resonance frequencies and has an energy not concentrating to a specific frequency since distances from voice coil 108 to outer periphery 107B along diaphragm 107 are different from each other depending on an angle.

The inside of voice coil 108, i.e., an inside of diaphragm 107 from coupling section 107A with voice coil 108 has a circular shape, hence easily resonating. If height H106 of diaphragm 107 is small so as to reduce the thickness of the loudspeaker, diaphragm 107 has a small rigidity, hence often causing unnecessary resonance. Being made of a resin film sheet, diaphragm 107 has a small internal loss and often resonates.

Diaphragm 107 has a cross section with a single arc shape to allow a metal mold for forming the diaphragm to be prepared easily.

The small rigidity of diaphragm 107 provides the loudspeaker with a low upper limit frequency. In order to reduce the thickness of diaphragm 107 having the cross section having the single arc shape, diaphragm 107 has a large apex angle T106 at coupling section 107A, hence reducing the rigidity of coupling section 107A.

SUMMARY OF THE INVENTION

A loudspeaker includes a magnetic circuit having a magnetic gap, a frame coupled to the magnetic circuit, a voice coil having a first end positioned in the magnetic gap and a second end opposite to the first end, and a diaphragm coupled to the second end of the voice coil and the frame. The voice coil has a center axis provided through the first end and the second end. The diaphragm has a first portion in which the center axis of the voice coil is provided. The first portion of the diaphragm is provided inside the voice coil. The diaphragm further has a second portion outside the voice coil. One of the first portion and the second portion of the diaphragm has a cross section in a plane including the center axis, and the cross section of the one of the first portion and the second portion of the diaphragm has an elliptic-arc shape.

This loudspeaker has a small thickness, has a high sound pressure level in a high frequency range, and secures a wide reproduction range in high frequencies.

BRIEF DESCRIPTION OF THE DRAWINGS

FIG. 16 is a cross-sectional view of a conventional loudspeaker.

FIG. 17 is a cross-sectional view of a diaphragm of the conventional loudspeaker.

FIG. 18 is a cross-sectional view of another conventional loudspeaker.

DESCRIPTION OF THE PREFERRED EMBODIMENTS

Exemplary Embodiment 1

Figure 1:
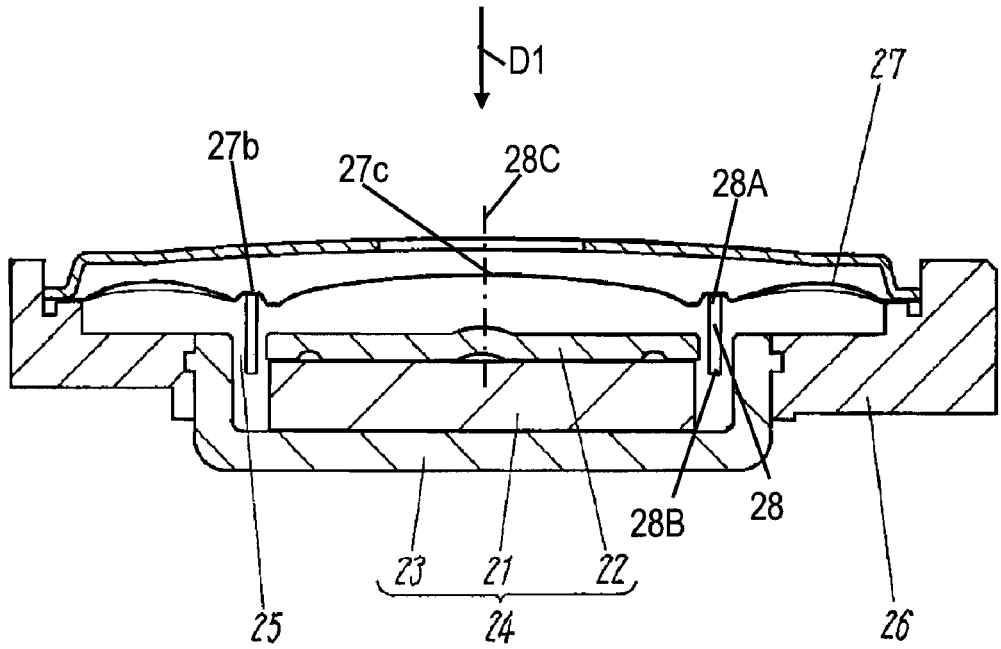
FIG. 1 is a cross-sectional view of a loudspeaker according to Exemplary Embodiment 1 of the present invention.

FIG. 1 is a cross-sectional view of a loudspeaker according to Exemplary Embodiment 1 of the present invention. Magnetic circuit 24 includes upper plate 22, yoke 23, and magnet 21 sandwiched between upper plate 22 and yoke 23, and has magnetic gap 25. Yoke 23 is coupled to frame 26. Cylindrical voice coil 28 has a circular shape as seen from direction D1. One end 28A of voice coil 28 is coupled to diaphragm 27 and the other end 28B is positioned in magnetic gap 25 of magnetic circuit 24.

Figure 2:
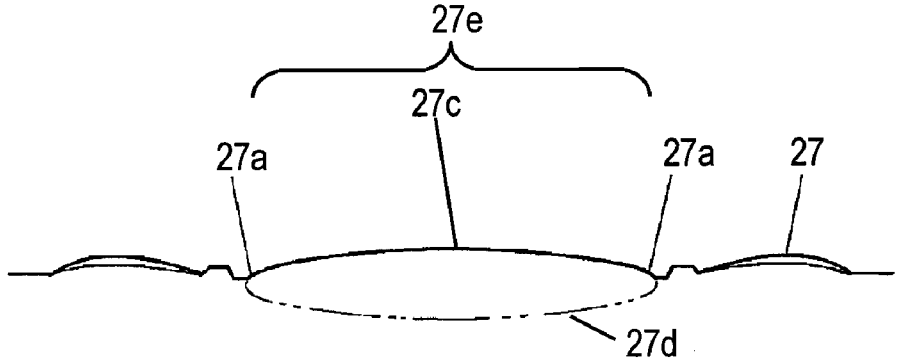
FIG. 2 is a cross-sectional view of a diaphragm of the loudspeaker according to Embodiment 1.

FIG. 2 is a cross-sectional view of diaphragm 27 in a plane including center axis 28C of voice coil 28 of the loudspeaker shown in FIG. 1. In portion 27*e* of diaphragm 27 provided from coupling section 27*b* at which voice coil 28 is coupled with the diaphragm to center 27*c*, diaphragm 27 has a cross section having an elliptic arc of ellipse 27*d* (which, as shown, is a non-circular ellipse). Neighborhood 27*a* of coupling section 27*b* of diaphragm 27 has a small curvature to provide diaphragm 27 with a large rigidity. Hence, diaphragm 27 can transmit and reproduce a vibration of voice coil 28 with a small loss, having a sound pressure level in a high frequency range and a high limit frequency.

Exemplary Embodiment 2

Figure 3:
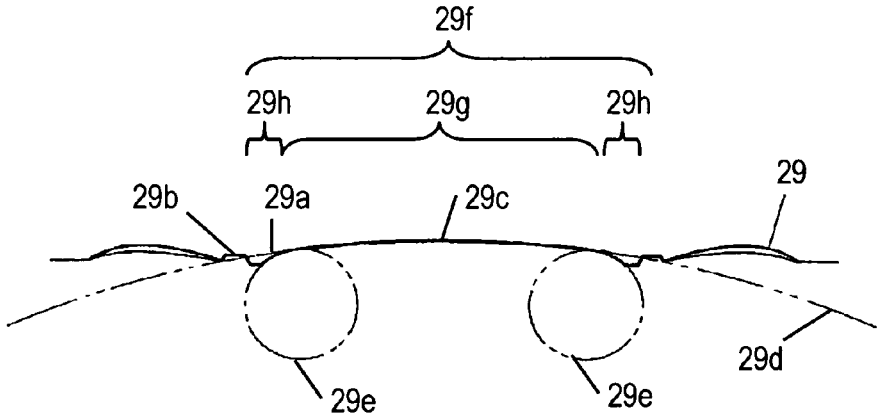
FIG. 3 is a cross-sectional view of a diaphragm of a loudspeaker according to Exemplary Embodiment 2 of the invention.

FIG. 3 is a cross-sectional view of diaphragm 29 of a loudspeaker according to Exemplary Embodiment 2 of the present invention. The loudspeaker shown in FIG. 3 has the same components as those of the loudspeaker according to Embodiment 1 shown in FIG. 1 except for the diaphragm, and their description is omitted.

Portion 29*f* of diaphragm 29 is provided from coupling section 29*b* at which voice coil 28 is coupled with the diaphragm to center 29*c*. Portion 29*f* has a cross section having a shape including respective arcs of two circles 29*d* and 29*e* having different radii and connected to each other. That is, portion 29*f* has the cross section including arc portion 29*g* of circle 29*d* and arc portion 29*h* of circle 29*e*. Portion 29*g* adjoins portion 29*h* and is farther from coupling section 29*b* than portion 29*h*. Circle 29*e* closer to coupling section 29*b* has a radius smaller than that of circle 29*d* closer to center 29*c*. This arrangement increases the rigidity in the neighborhood 29*a* of coupling section 29*b* of diaphragm 29 to voice coil 28. Hence, diaphragm 29 can transmit and reproduce vibration of voice coil 28 with a small loss, having a sound pressure level in a high frequency range and a high limit frequency.

Exemplary Embodiment 3

Figure 4:
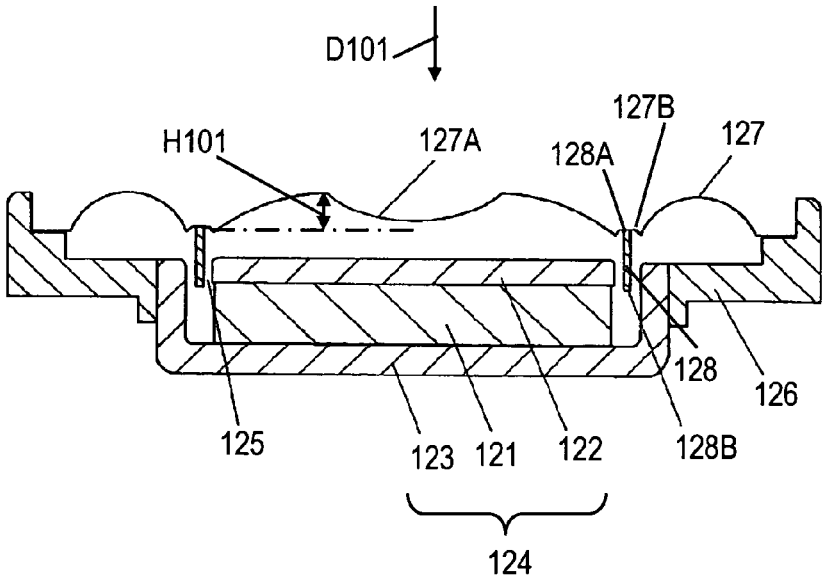
FIG. 4 is a cross-sectional view of a loudspeaker according to Exemplary Embodiment 3 of the invention.
Figure 5:
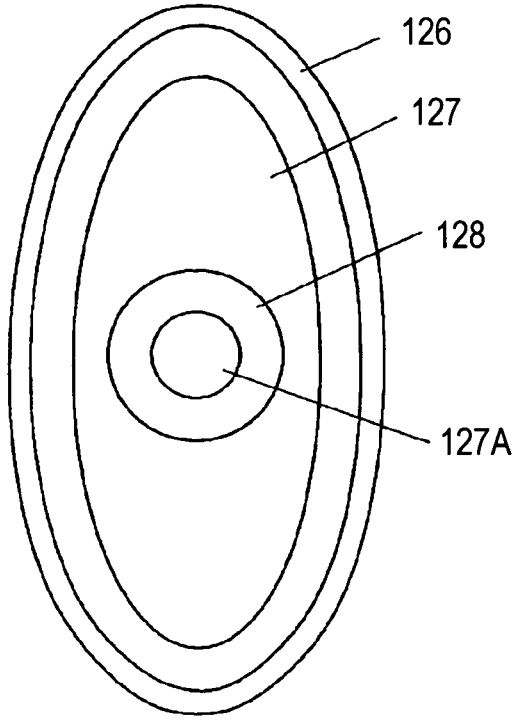
FIG. 5 is a plan view of the loudspeaker according to Embodiment 3.

FIG. 4 is a cross-sectional view of a loudspeaker according to Exemplary Embodiment 3 of the present invention. FIG. 5 is a plan view of the loudspeaker shown in FIG. 4. Internal-magnet type magnetic circuit 124 includes upper plate 122, yoke 123, and magnet 121 sandwiched between upper plate 122 and yoke 123, and has magnetic gap 125. Yoke 123 is coupled with elliptical frame 126. Elliptical frame 126 has a non-circular shape. A periphery of elliptical frame 126 is adhered with the outer periphery of elliptical diaphragm 127 for covering the inner and outer sides of voice coil 128. Voice coil 128 has a cylindrical shape and a cross section having a circular shape seen from direction D101. One end 128A of voice coil 128 is coupled to diaphragm 127 at coupling section 127B while the other end 128B is positioned in magnetic gap 125 of magnetic circuit 124. The inner portion of diaphragm 127 inside coupling section 127B at which voice coil 128 is coupled to the diaphragm has dent 127A formed therein. Dent 127A reduces overall height H101 of diaphragm 127 and increases its rigidity. Thus, diaphragm 127 reduces unnecessary resonance and provides the loudspeaker with a small thickness and flat sound-pressure frequency characteristics.

Exemplary Embodiment 4

Figure 6:
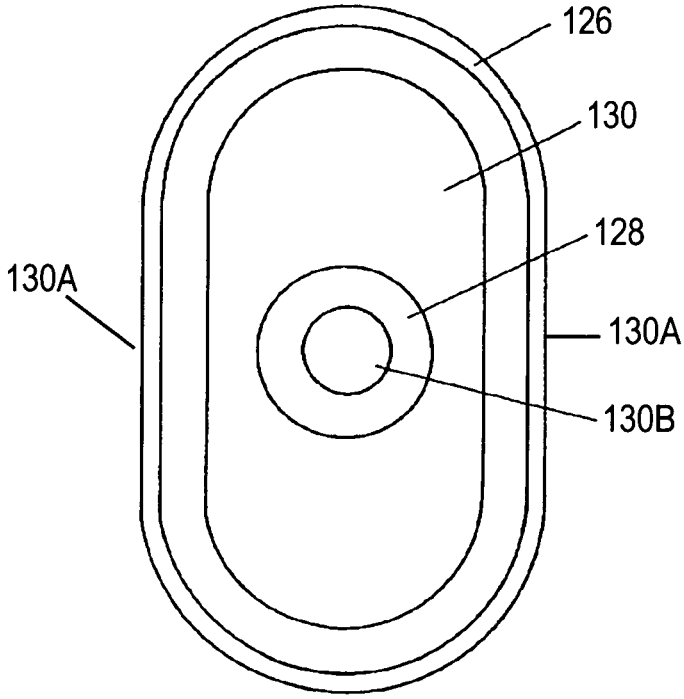
FIG. 6 is a plan view of a loudspeaker according to Exemplary Embodiment 4 of the invention.

FIG. 6 is a plan view of a loudspeaker according to Exemplary Embodiment 4 of the present invention. Diaphragm 127 of the loudspeaker according to Embodiment 3 shown in FIG. 5 has an elliptical outer shape, however, the shape is not limited to the elliptical shape and may be any non-circular shape other than a circular shape. FIG. 6 shows diaphragm 130 having a track-like oval outer shape including straight sections 130A. The inner portion of diaphragm 130 inside voice coil 128 has dent 130B formed therein similar to dent 127A shown in FIG. 4. Straight sections 130A may be arranged at each side of a display device, such as a liquid crystal display panel, and in parallel to the display device, thus reducing the size of an apparatus including the display device and the loudspeaker.

Exemplary Embodiment 5

Figure 7:
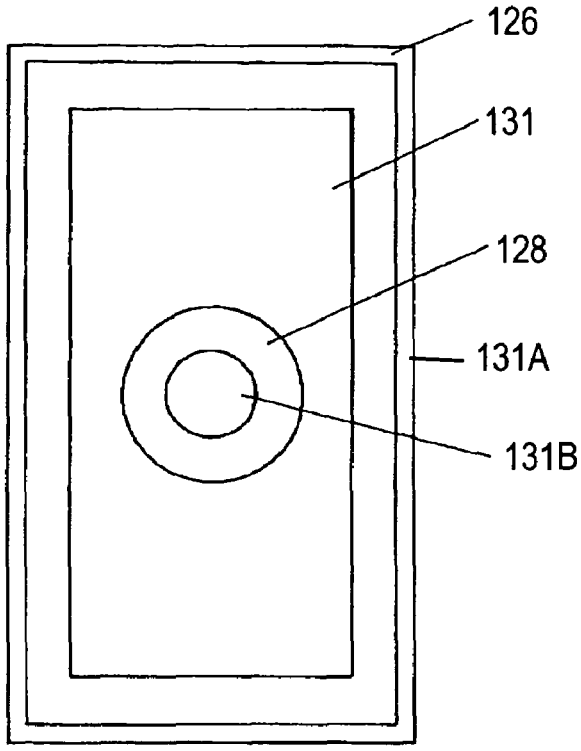
FIG. 7 is a plan view of a loudspeaker according to Exemplary Embodiment 5 of the invention.

FIG. 7 is a plan view of a loudspeaker according to Exemplary Embodiment 5 of the present invention. The loudspeaker shown in FIG. 7 has diaphragm 131 having a rectangular outer shape. The inner portion of diaphragm 131 inside voice coil 128 has dent 131B formed therein similarly to dent 127A shown in FIG. 4. Longer sides 131A may be arranged at each side of a display device, such as a liquid crystal display panel, and in parallel to the display device, thus reducing the size of an apparatus including the display device and the loudspeaker.

Exemplary Embodiment 6

Figure 8:
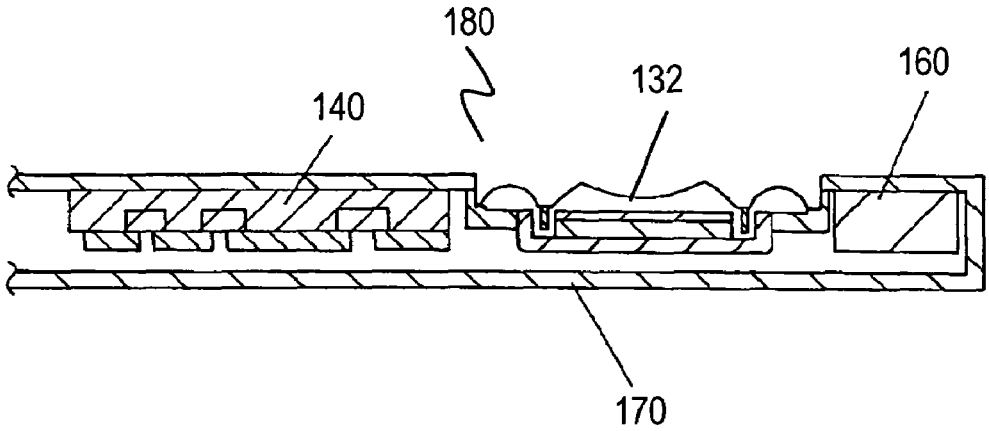
FIG. 8 is a cross-sectional view of an apparatus according to Exemplary Embodiment 6 of the invention.

FIG. 8 is a cross-sectional view of portable telephone 180 as an apparatus according to Exemplary Embodiment 6 of the present invention. Portable telephone 180 includes loudspeaker 132 according to any of Embodiments 3 to 5 shown in FIG. 4 to FIG. 7, electronic circuit 140, liquid crystal display device 160, and case 170 accommodating them. Loudspeaker 132 is thin, hence reducing the thickness and the size of portable telephone 180.

Exemplary Embodiment 7

Figure 9:
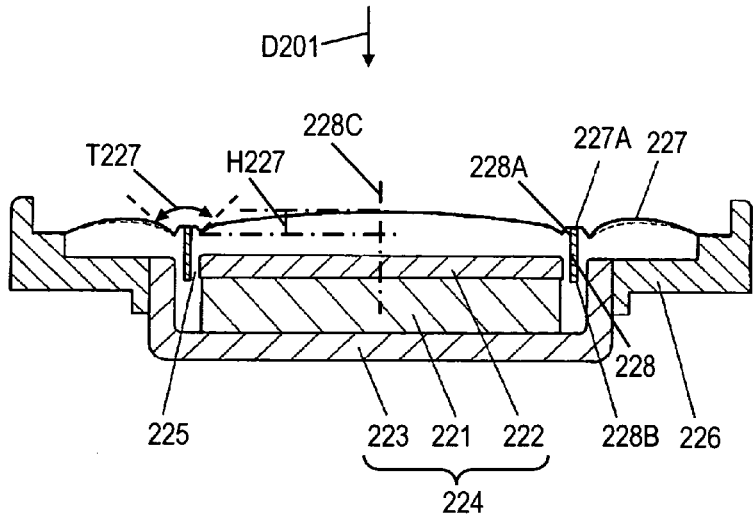
FIG. 9 is a cross-sectional view of a loudspeaker according to Exemplary Embodiment 7 of the invention.

FIG. 9 is a cross-sectional view of a loudspeaker according to Exemplary Embodiment 7 of the present invention. Internal-magnet type magnetic circuit 224 includes upper plate 222, yoke 223, and magnet 221 sandwiched between upper plate 222 and yoke 223, and has magnetic gap 225. Voice coil 228 has a cylindrical shape and has a circular cross section seen from direction D201. One end 228A of voice coil 228 is coupled to diaphragm 227 at coupling section 227A while the other end 228B is positioned in magnetic gap 225 of magnetic circuit 224.

FIGS. 10A to 10F are cross-sectional views of diaphragms 2771 to 2776 corresponding to diaphragm 227 in a plane including center axis 228C of voice coil 228.

Figure 10A:
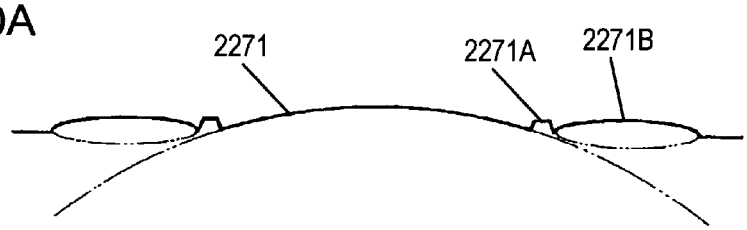
FIGS. 10A to 10F are cross-sectional views of diaphragms of the loudspeaker according to Embodiment 7.

In diaphragm 2271 shown in FIG. 10A, portion 2271B outside coupling section 2271A at which voice coil 228 is coupled with the diaphragm has an elliptic-arc cross section (i.e. a cross section shaped as an arc of a non-circular ellipse).

Figure 10B:
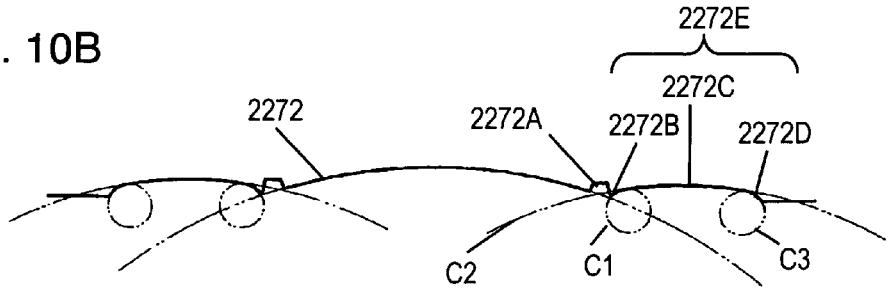

In diaphragm 2272 shown in FIG. 10B, portion 2272E outside coupling section 2272A at which voice coil 228 is coupled with the diaphragm has a cross section including an arc of circle C1, an arc of circle C2, and an arc of circle C3. Circle C1 is provided at neighborhood 2272B of coupling section 2272A. Circle C2 is provided at portion 2272C outside neighborhood 2272B and has a radius larger than that of circle C1. Circle C3 is provided at portion 2272D outside portion 2272C and has a radius smaller than that of circle C2.

Figure 10C:
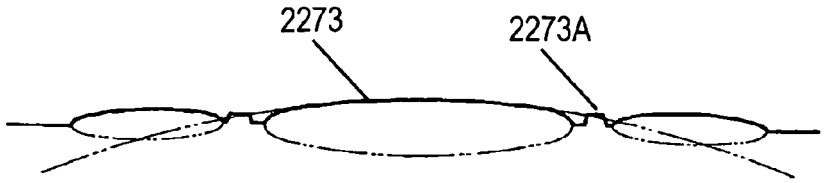

In diaphragm 2273 shown in FIG. 10C, portion 2273B inside coupling section 2273A at which voice coil 228 is coupled with the diaphragm has an elliptic arc cross section similarly to portion 2271B of FIG. 10A.

Figure 10D:
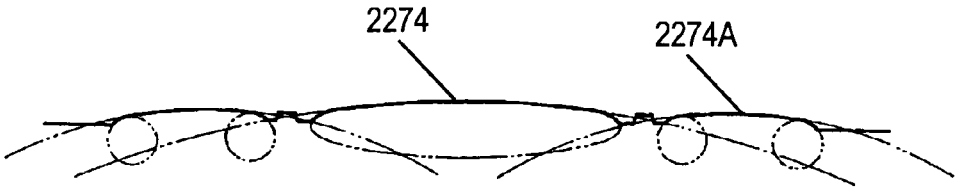

In diaphragm 2274 shown in FIG. 10D, an inner portion inside coupling section 2274A at which voice coil 228 is coupled with the diaphragm has an elliptic arc cross section. An outer portion outside it has a cross section including plural arcs similarly to portions 2272B to 2272D of diaphragm 2272 shown in FIG. 10B.

Figure 10E:
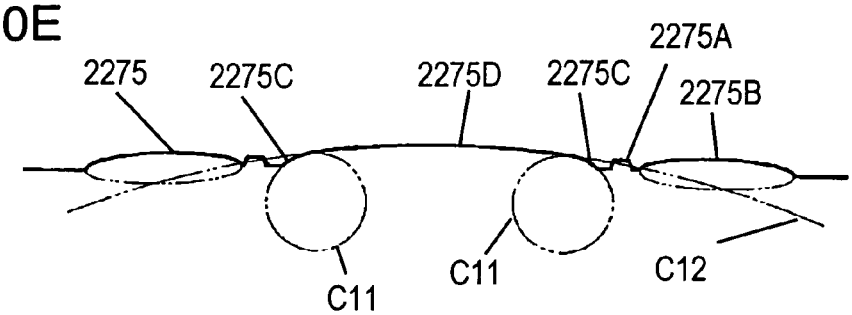

In diaphragm 2275 shown in FIG. 10E, portion 2275B outside coupling section 2275A at which voice coil 228 is coupled with an elliptic-arc cross section. An inner portion inside the section has a cross section including plural arcs similarly to portions 2272B to 2272D of diaphragm 2272 shown in FIG. 10B. That is, portions 2275C closer to coupling section 2275A have cross sections having arcs of circles C11. Portion 2275D close to portion 2275C and farther from coupling section 2275A than portion 2275C has a cross section having an arc of circle C12 having a radius larger than the radii of circles C11.

Figure 10F:
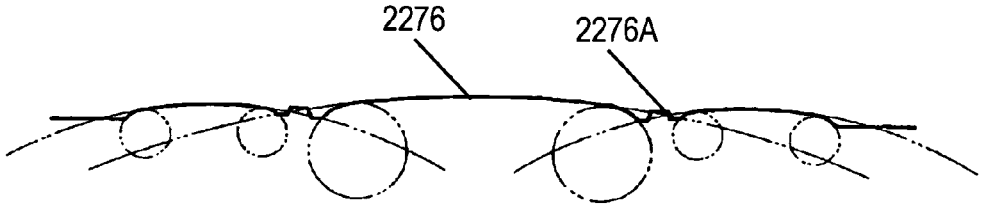

In diaphragm 2276 shown in FIG. 10F, each of an inner portion inside coupling section 2276A at which voice coil 228A is coupled with the diaphragm and an outer portion outside coupling section 2276A has a cross section including plural arcs similarly to portions 2272B to 2272D of diaphragm 2272 shown in FIG. 10B.

In diaphragms 2271 to 2276 shown in FIG. 9 and FIG. 10A to FIG. 10F, apex angle T227 (FIG. 9) at the vicinity of the coupling section at which voice coil 228 is coupled to the diaphragm may be reduced, and height H227 can be reduced. The diaphragm having a cross section having small apex angle T227 small height H227 provides the same effects as those of Embodiment 1.

Small apex angle T227 increases the rigidity of diaphragm 227, and allows the vibration of voice coil 228 to be transmitted to diaphragm 227 well, thus providing the loudspeaker with a high upper limit frequency and a small thickness.

Diaphragm 227 having the elliptic-arc cross section has a shape that can be defined by a simple function, and can be manufactured effectively with a production tool, such as a metal mold.

Furthermore, a portion of diaphragm 227 inside voice coil 228 may have a cross section having the above-described shape to the inner side of voice coil 228, and has a large rigidity, hence providing the loudspeaker with a high upper limit frequency and a small thickness.

Diaphragms 227 and 2271 to 2276 are made of sheet-like resin. Thus, diaphragms 227 and 2271 to 2276 can be formed easily and can have a small weight.

Coupling sections 227A and 2271A to 2276A of diaphragms 227 and 2271 to 2276 at which voice coil 228 is coupled to the diaphragms have groove-like guides 227E and 2271E to 2276E to which voice coil 228 is partially inserted. Guides 227E and 2271E to 2276E allow diaphragms 227 and 2271 to 2276 to be coupled to voice coil 228 at a high productivity. Guides 227E and 2271E to 2276E increase the rigidity of coupling sections 227 and 2271A to 2276A, thus allowing vibration of voice coil 228 to be transmitted to diaphragms 227 and 2271 to 2276 securely without a loss, thus providing the loudspeaker with a high upper limit frequency and a small thickness.

Exemplary Embodiment 8

Figure 11:
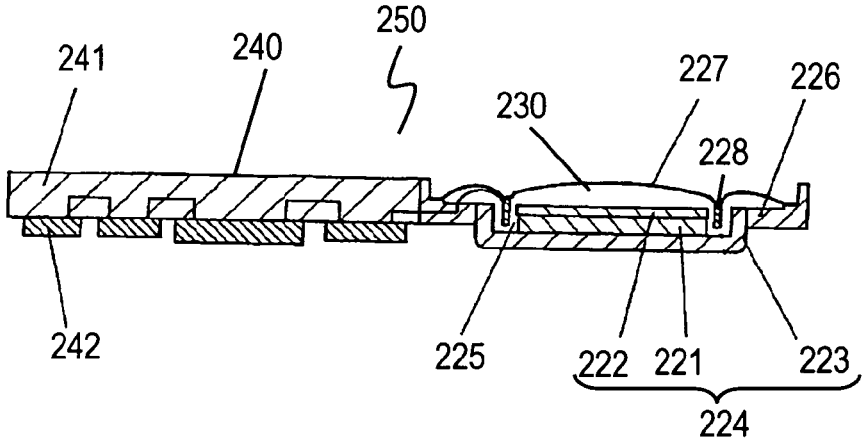
FIG. 11 is a cross-sectional view of a speaker module according to Exemplary Embodiment 8 of the invention.

FIG. 11 is a cross-sectional view of speaker module 250 as an apparatus according to exemplary Embodiment 8 of the present invention. Speaker module 250 includes loudspeaker 230 as shown in any of FIG. 9 and FIGS. 10A to 10F and electronic circuit 240 integrated with loudspeaker 230. In electronic circuit 240, electronic component 242 is fixed and wired to circuit board 241. Electronic circuit 240 includes an amplifier for amplifying a signal supplied to loudspeaker 230. Loudspeaker 230 is integrated with the amplifier for amplifying a sound signal to a level required for output from the loudspeaker. Thus, speaker module 250 may be just coupled to a circuit for generating the sound signal so as to provide a sound output easily.

Speaker module 250 may be used in a communication apparatus, such as a portable telephone. In this case, module 250 may further include a circuit required for communication, such as a detector, a modulator, and a demodulator, a driving circuit for driving a display device (e.g., a liquid crystal display panel), and various circuits (e.g., a power supply, a charging circuit) as well as electronic circuit 240 and the amplifier. Conventionally, loudspeaker 230 and electronic circuit 240 have been separately produced and then supplied through separate inspection processes and separate distribution processes to a factory of the apparatus, such as the portable telephone. Module 250 including loudspeaker 230 and electronic circuit 240 described above can unify the production processes, the inspection processes, and the distribution processes, thus reducing its cost significantly. Thus, speaker module 250 including loudspeaker 230 and electronic circuit 240 integrated may provide a low cost. Loudspeaker 230 has a small size and a small thickness, thus allowing speaker module 250 to have a small size and a small thickness.

Exemplary Embodiment 9

Figure 12:
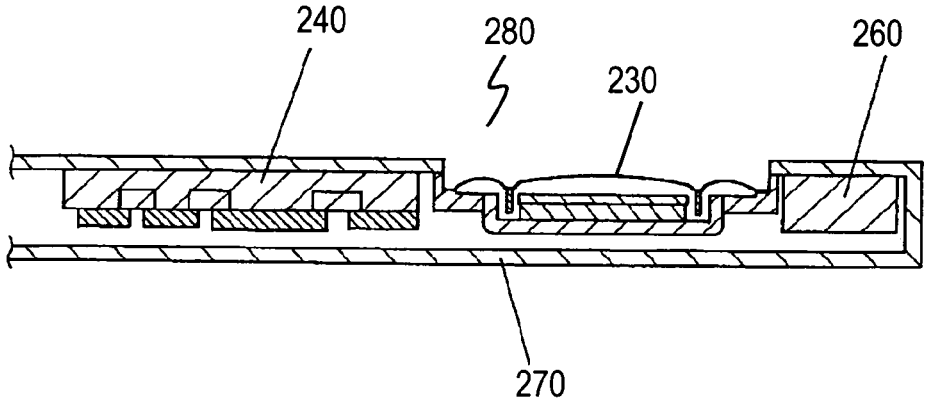
FIG. 12 is a cross-sectional view of an essential part of an electronic device according to Exemplary Embodiment 9 of the invention.

FIG. 12 is a cross-sectional view of cellular telephone 280 as an apparatus of Embodiment 9. Cellular telephone 280 includes loudspeaker 230 according to Embodiment 7 shown in FIG. 9 and FIGS. 10A to 10F, electronic circuit 240, display device 260 (e.g., liquid crystal panel), and container 270 for storing them. Loudspeaker 230 has a small size and a reduced thickness and thus cellular telephone 280 can have a small size and a reduced thickness.

Exemplary Embodiment 10

Figure 13:
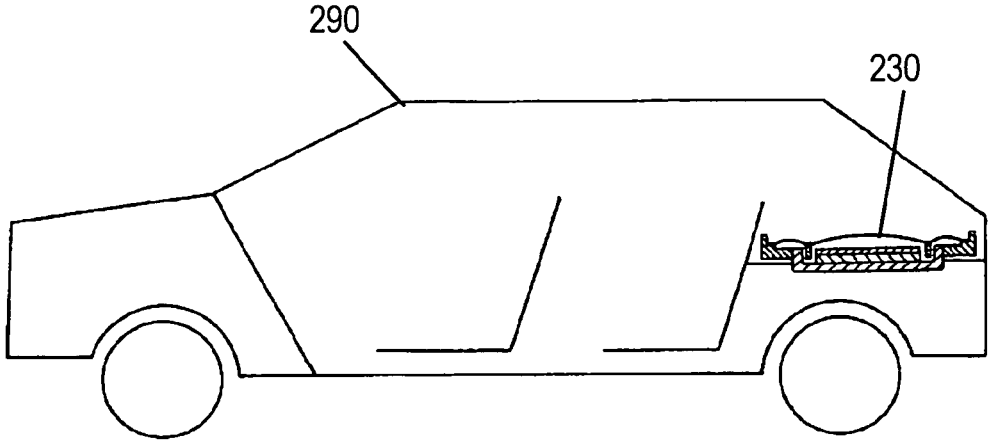
FIG. 13 is a cross-sectional view of an apparatus according to Exemplary Embodiment 10 of the invention.

FIG. 13 is a cross-sectional view of automobile 290 as an apparatus according to Exemplary Embodiment 10. In automobile 290, loudspeaker 230 according to Embodiment 7 shown in FIG. 9 and FIGS. 10A to 10F is mounted to a rear tray or a front panel as to be used as a part of a system, such as a car navigation system and a car audio system. Loudspeaker 230 has a small size and a small thickness thus reducing the size and the thickness of the system including loudspeaker 230.

Exemplary Embodiment 11

Figure 14:
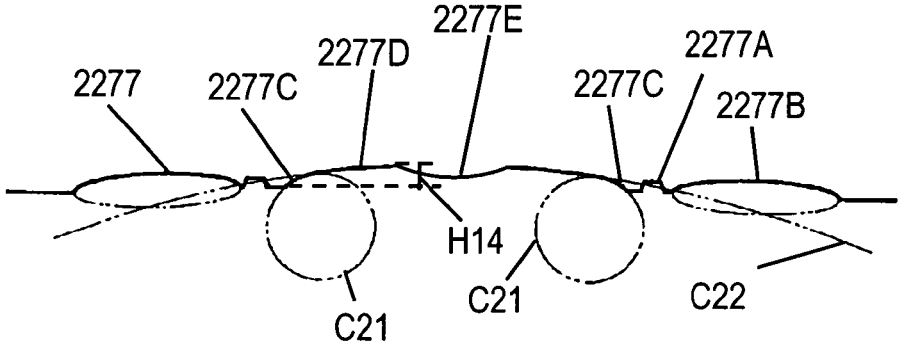
FIG. 14 is a cross-sectional view of a diaphragm of a loudspeaker according to Exemplary Embodiment 11 of the invention.

FIG. 14 shows diaphragm 2277 of a loudspeaker according to Exemplary Embodiment 11. The loudspeaker according to Embodiment 11 has a structure similar to that of the loudspeaker shown in FIG. 9. Diaphragm 2277 corresponds to diaphragm 227 shown in FIG. 9. FIG. 14 is a cross-sectional view of diaphragm 2277 in a plane including center axis 228C of voice coil 228.

Diaphragm 2277 has a cross section substantially identical to that of diaphragm 2275 shown in FIG. 10E. Portion 2277B outside coupling section 2277A at voice coil 228 is coupled with the diaphragm and has an elliptic arc cross section while a portion inside the section has a cross section including plural arcs similar to portions 2272B to 2272D of diaphragm 2272 shown in FIG. 10B. That is, portions 2277C closer to coupling sections 2277A have cross sections including arcs of circles C21. Portion 2277D adjoining portions 2277C and farther from coupling section 2277A than portions 2277C has a cross section including an arc of circle C22 having a radius larger than the radii of circles C21.

In diaphragm 2277, portion 2277D inside coupling section 2277A has dent 2277E formed therein. Dent 2277E reduces overall height H14 of diaphragm 2277 and increases its rigidity. Thus, diaphragm 2277 has a small unnecessary resonance, and allows the loudspeaker to have a small thickness and flat sound pressure frequency characteristics.

Diaphragm 2277 according to Embodiment 11 has a structure substantially identical to that of diaphragm 2275 shown in FIG. 10E. However, the structure of Diaphragm 2277 is not limited to this. For example, each diaphragm shown in FIG. 3 and FIGS. 10A to 10F may have a dent formed therein.

The outer shape of the loudspeaker according to Embodiment 11 is not limited to a circular shape, and may have a non-circular shape, such as an elliptical shape, an oval shape, or a rectangular shape, similarly to the loudspeakers shown in FIG. 5 to FIG. 7.

Exemplary Embodiment 12

Figure 15:
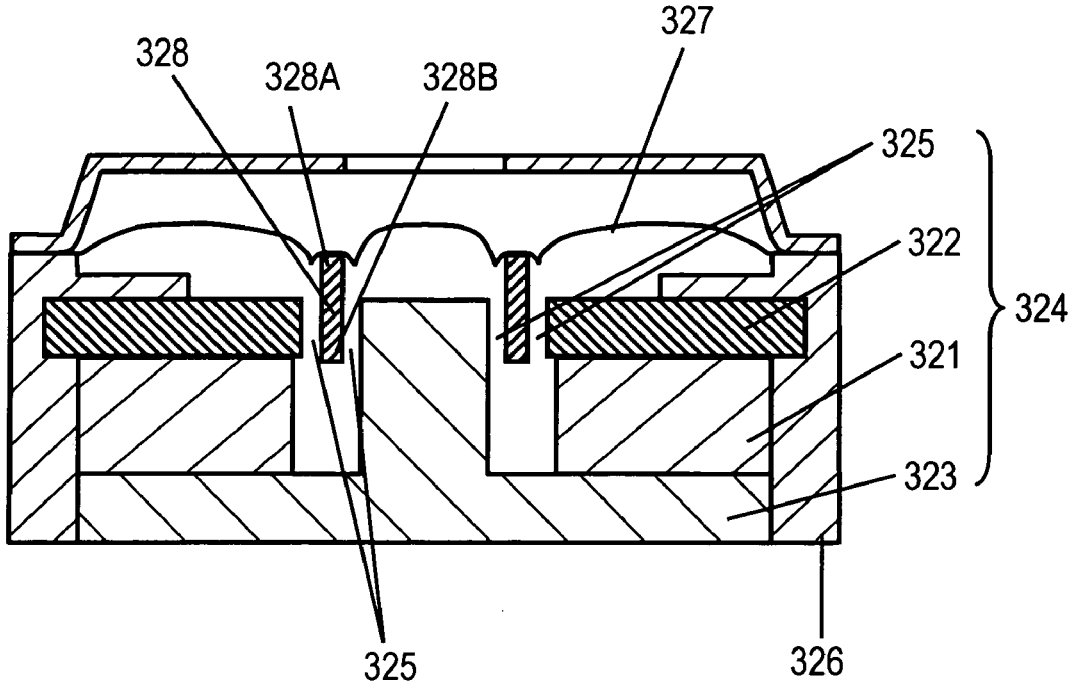
FIG. 15 is a cross-sectional view of a loudspeaker according to Exemplary Embodiment 12 of the invention.

FIG. 15 is a cross-sectional view of a loudspeaker according to Exemplary Embodiment 12 of the present invention. This loudspeaker is an outer-magnet type loudspeaker. Magnetic circuit 324 has magnetic gap 325 and includes magnet 321, upper plate 322, and lower plate 323. Magnets 321 is sandwiched between upper plate 322 and lower plate 323. This loudspeaker includes diaphragm 327. Diaphragm 327 and magnetic circuit 324 are fixed to frame 326. One end 328A of voice coil 328 is connected to diaphragm 327 while the other end 328B thereof is positioned in magnetic gap 325.

Magnetic circuit 24 of the loudspeaker according to Embodiments 1 to 11 is an internal-magnet type magnetic circuit which includes upper plate 22, yoke 23, and magnet 21 sandwiched between upper plate 22 and yoke 23, and has magnetic gap 25. The diaphragm according to Embodiments 1 to 11 may be used as diaphragm 327 of the outer-magnet type loudspeaker shown in FIG. 15, providing the same effect.

INDUSTRIAL APPLICABILITY

A loudspeaker according to the present invention has a small thickness, has a high sound pressure level in a high frequency range, and can secure a reproduction band in a high frequency range.

The invention claimed is:

1. A loudspeaker comprising:

a magnetic circuit having a magnetic gap;

a frame coupled to the magnetic circuit;

a voice coil having a first end positioned in the magnetic gap and a second end opposite to the first end, the voice coil having a center axis provided through the first end and the second end; and a diaphragm coupled to the second end of the voice coil and the frame, the diaphragm having a first portion in which the center axis of the voice coil is provided, the first portion of the diaphragm being provided inside the voice coil, the diaphragm further having a second portion outside the voice coil, wherein one of the first portion and the second portion of the diaphragm has a cross section in a plane along which the center axis extends, and the cross section of the one of the first portion and the second portion of the diaphragm is shaped as an arc of a non-circular ellipse.

2. The loudspeaker according to claim 1, wherein the other of the first portion and the second portion of the diaphragm includes a third portion having a cross section in the plane including the center axis, the cross section of the third portion including a first arc, and a fourth portion having a cross section in the plane including the center axis, the cross section of the fourth portion including a second arc having a radius larger than a radius of the first arc, the fourth portion adjoining the third portion and being farther from the second end of the voice coil than the third portion.

3. The loudspeaker according to claim 1, wherein the other of the first portion and the second portion of the diaphragm has a cross section in the plane including the center axis, and the cross section of the other of the first portion and the second portion of the diaphragm is shaped as an arc of a non-circular ellipse.

4. The loudspeaker according to claim 1, wherein the diaphragm comprises resin material.

5. The loudspeaker according to claim 1, wherein the diaphragm further has a guide coupled with the second end of the voice coil.

6. The loudspeaker according to claim 1, wherein the diaphragm has a groove to which the second end of the voice coil is inserted.

7. The loudspeaker according to claim 1, wherein the first portion of the diaphragm has a dent formed therein.

* * * * *